US007121206B2

(12) United States Patent
Imai et al.

(10) Patent No.: US 7,121,206 B2
(45) Date of Patent: Oct. 17, 2006

(54) SAFETY BAR INCLUDING OPENING FOR RELEASING AIR ENGULFED BETWEEN TWO ROTATING MEMBERS AND SAFETY BAR

(75) Inventors: Yasuhiro Imai, Noda (JP); Fuminori Matsuura, Noda (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 10/885,671

(22) Filed: Jul. 8, 2004

(65) Prior Publication Data

US 2005/0005798 A1 Jan. 13, 2005

(30) Foreign Application Priority Data

Jul. 11, 2003 (JP) ..... 2003-195559

(51) Int. Cl.
*B41F 13/42* (2006.01)

(52) U.S. Cl. ..... 101/480; 101/216

(58) Field of Classification Search ..... 101/480, 101/477, 216, 212, 494
See application file for complete search history.

(56) References Cited

U.S. PATENT DOCUMENTS 5,259,313 A * 11/1993 Gibson et al. ..... 101/425
5,440,988 A * 8/1995 Ito ..... 101/477
5,537,922 A * 7/1996 Becker ..... 101/216
5,875,714 A * 3/1999 Winkler et al. ..... 101/216
5,906,163 A 5/1999 Gagne et al.
6,644,192 B1 * 11/2003 Dilling et al. ..... 101/480
6,892,634 B1 * 5/2005 Mezger et al. ..... 101/216

FOREIGN PATENT DOCUMENTS

JP 59-22755 * 2/1984 ..... 101/415.1
JP 2525261 Y2 11/1996

* cited by examiner

*Primary Examiner*—Leslie J. Evanisko
(74) *Attorney, Agent, or Firm*—Birch, Stewart, Kolasch & Birch, LLP

(57) ABSTRACT

A covering device for rotating parts comprises a plate cylinder supported rotatably, a blanket cylinder opposed to the plate cylinder and supported rotatably, and a wrap-in preventing safety bar, located in a vicinity of these cylinders, for covering at least a spacing between these cylinders, the safety bar being provided with air vents.

6 Claims, 4 Drawing Sheets

SAFETY BAR INCLUDING OPENING FOR RELEASING AIR ENGULFED BETWEEN TWO ROTATING MEMBERS AND SAFETY BAR

CROSS REFERENCE TO RELATED APPLICATION

The entire disclosure of Japanese Patent Application No. 2003-195559 filed on Jul. 11, 2003, including specification, claims, drawings and summary, is incorporated herein by reference in its entirety.

BACKGROUND OF THE INVENTION

1. Field of the Invention

This invention relates to a covering device for rotating parts, such as a safety cover and a guide, in a rotary press.

2. Description of the Related Art

As shown in FIG. 6, a web rotary press is generally configured as follows: In order to prevent something from being caught (so-called a wrap-in) into an area defined between and opposed to a plate cylinder 100 and a blanket cylinder 101 of a printing unit, a safety bar 102 extends along an axial direction of a cylinder shaft at a position upstream of the cylinders in the direction of cylinder rotation. In order to prevent ink scatter from around an area defined between and opposed to an ink form roller 103 and a rider roller 104 of ink rollers, a cover 105 is disposed at a position below these rollers 103 and 104 (upstream of these rollers in the direction of roller rotation) (see Japanese Utility Model Registration No. 2525261, FIGS. 1 and 2).

Because of the functions of the above-mentioned safety bar 102 and cover 105, the clearances between the safety bar 102 and the circumferential surfaces of the cylinders, and the clearances between the cover 105 and the circumferential surfaces of the rollers are narrow. While the cylinders 100 and 101 are rotating in the directions of arrows in FIG. 6, air is engulfed from the narrow clearances into a region surrounded by the circumferential surfaces of the cylinders and the safety bar 102 (the region indicated by a hatching in FIG. 6). While the rollers 103 and 104 are rotating in the directions of arrows in FIG. 6, air is engulfed from the narrow clearances into a region surrounded by the circumferential surfaces of the rollers and the cover 105 (the region indicated by a hatching in FIG. 6).

The air engulfed into any such region cannot escape through the narrow clearances to the outside, and builds up in each region, with its temperature rising in accordance with the rotations of the cylinders 100 and 101 and the rollers 103 and 104. As a result, a temperature difference emerges between the interior of the above region and the outside air, and dew forms on the surfaces of the safety bar 102 and the cover 105 located near those regions. Eventually, water droplets, which have fallen, adhere to printing products, causing a printing failure.

SUMMARY OF THE INVENTION

The present invention has been accomplished in light of the above-described and provides a covering device for rotating parts, the covering device being capable of preventing dew formation on covering members, such as a safety bar, a guide, and a cover.

One aspect of the present invention is to provide a covering device for rotating parts, comprising: a first rotating part supported rotatably; a second rotating part opposing the first rotating part and supported rotatably; and a covering member, located in a vicinity of the first rotating part and the second rotating part, for covering at least a spacing between the first rotating part and the second rotating part, the covering member being provided with an opening. Because of the opening, circulation and exchange of air in the region covered by the covering member and the outside air are promoted. As a result, the temperature difference between the interior of the region and the outside air is eliminated, making it possible to prevent dew formation on the covering member located in the vicinity of the region.

The opening may release air accumulating in an area upstream of a facing area, where the first rotating part and the second rotating part are opposed to each other, in the direction of rotation.

The covering member may be provided in a range surrounded by a facing area where the first rotating part and the second rotating part are opposed to each other, the first outer peripheral surface of the first rotating part upstream of the facing area in the direction of rotation of the first rotating part, the second outer peripheral surface of the second rotating part upstream of the facing area in the direction of rotation of the second rotating part, and a plane in contact with the first outer peripheral surface and the second outer peripheral surface.

The opening may be provided inwardly of opposite end portions of each of the first and second rotating parts.

A plurality of openings may be formed at predetermined intervals in the longitudinal direction of the first and second rotating parts.

The covering member may be a safety bar for preventing a wrap-in in a printing press.

The opening may be a hole provided in the safety bar.

The covering member may be a cover for preventing the scatter of a solvent.

The opening may be a hole provided in the cover.

The covering member may be a plate guide for guiding a plate during plate removal in a printing press equipped with a plate changing device.

The opening may be a hole provided in the plate guide.

The opening may be absent at a position corresponding to each of opposite end portions of the first and second rotating parts.

Opposite end portions of the first and second rotating parts may be located outwardly of a range in which the opening is provided.

The first and second rotating parts may be rolls of an inking device or a varnish coater or a dampener.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

A covering device for rotating parts according to the present invention will now be described in detail by an embodiment with reference to the accompanying drawings, which in no way limit the invention.

EMBODIMENT

Figure 1:
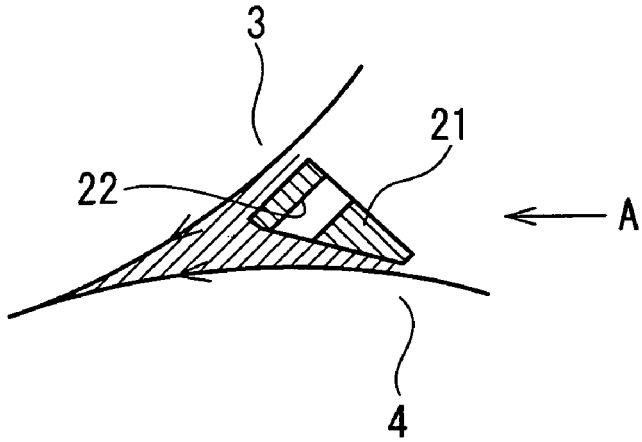
FIG. 1 is a side sectional view of the surroundings of a safety bar in a rotary press showing an embodiment of the present invention.
Figure 2:
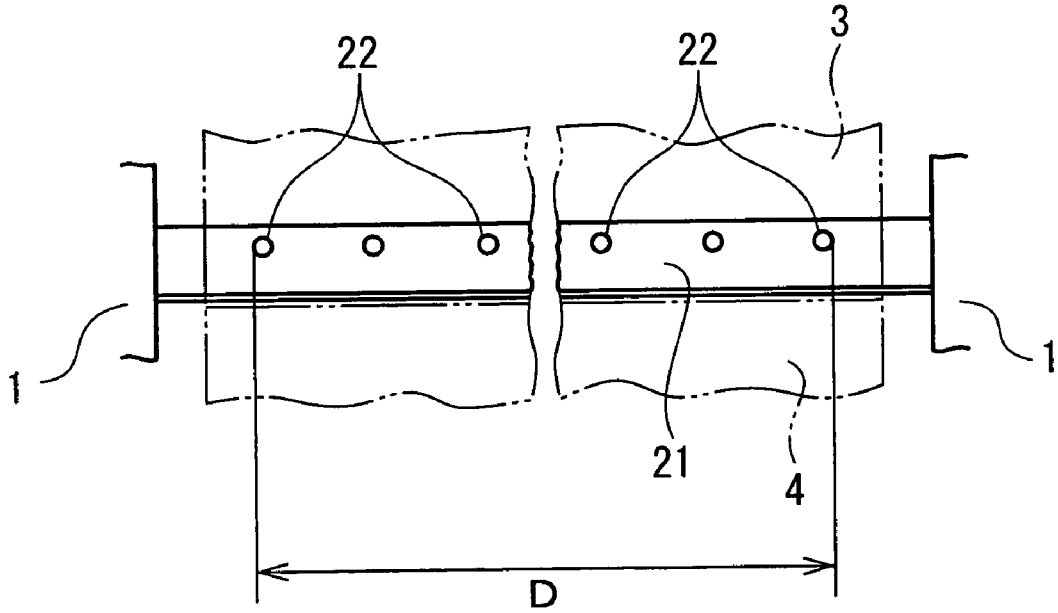
FIG. 2 is a view taken in the direction of an arrow A shown in FIG. 1.
Figure 3:
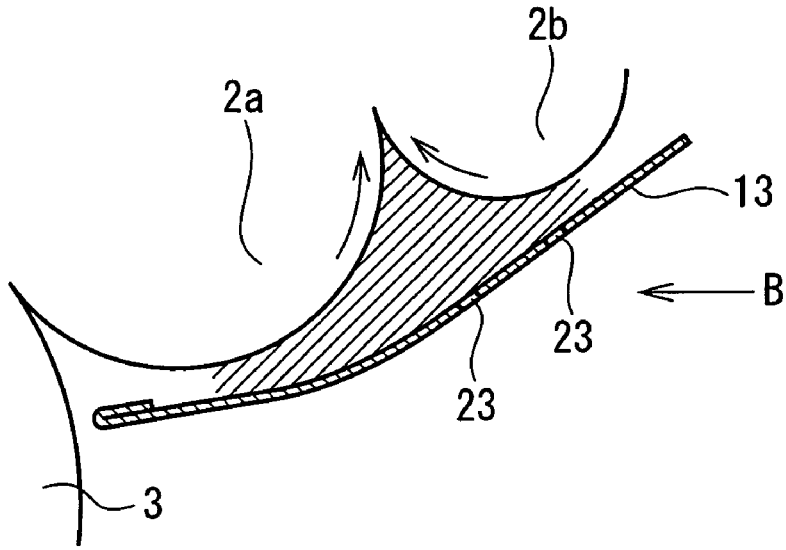
FIG. 3 is a side sectional view of the surroundings of a cover.
Figure 4:
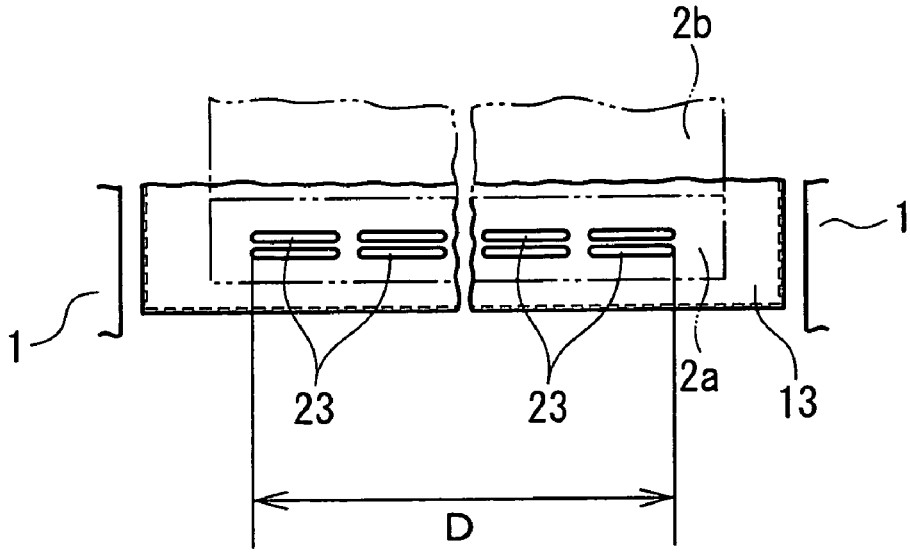
FIG. 4 is a view taken in the direction of an arrow B shown in FIG. 3.
Figure 5:
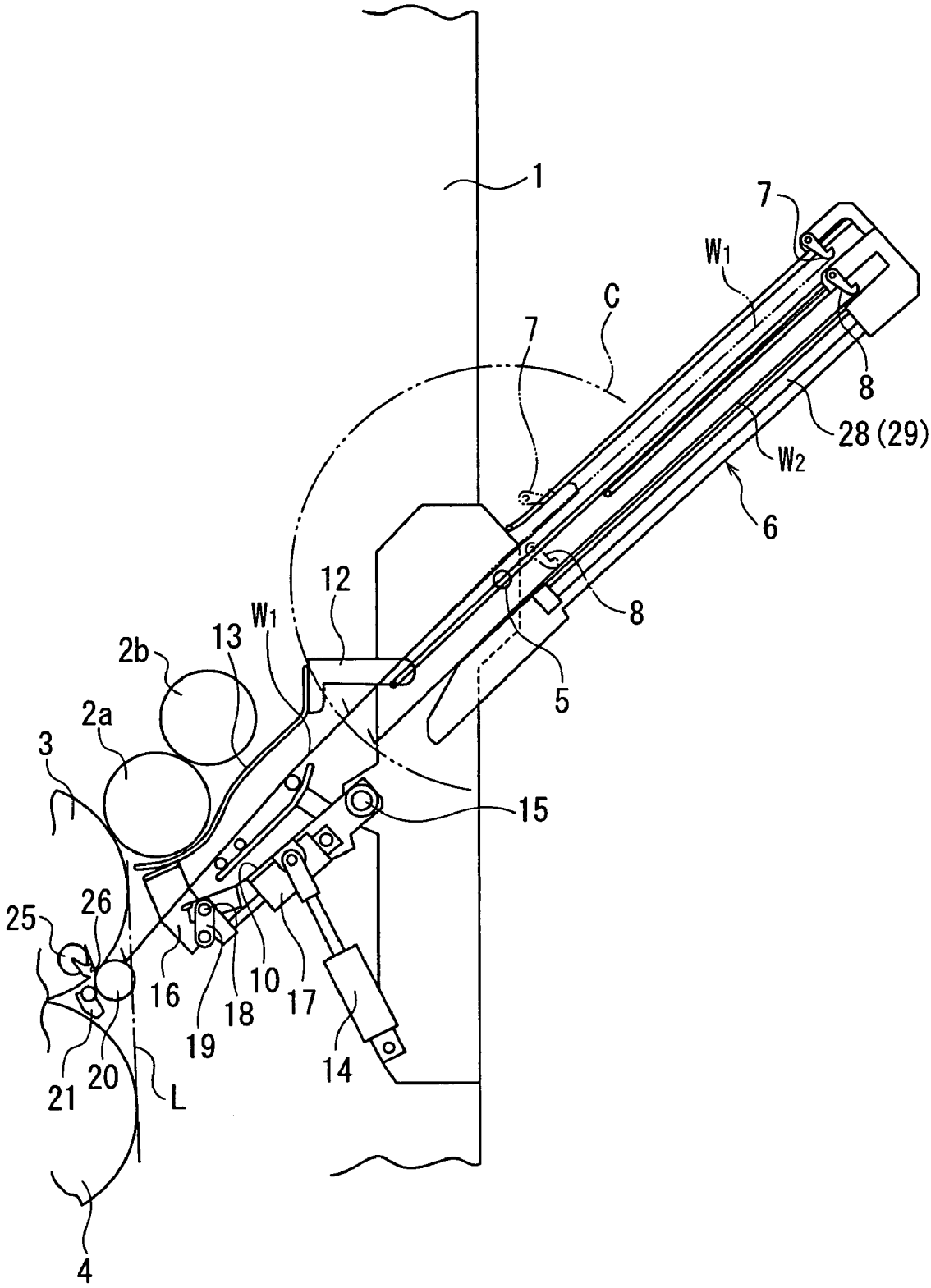
FIG. 5 is a schematic configuration drawing of the surroundings of a plate changing device.
Figure 6:
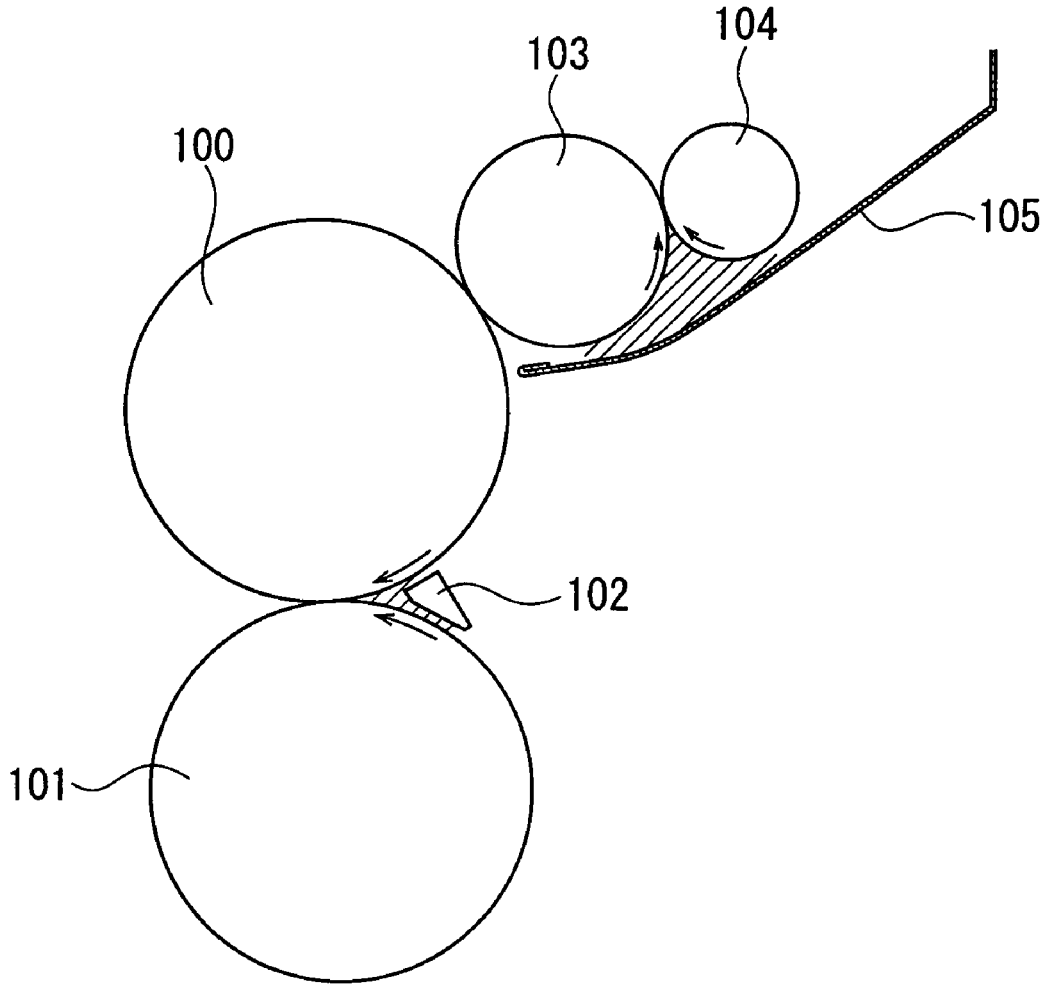
PRIOR ART Fig.6
FIG. 6 is a side view of essential parts of a conventional printing unit.

FIG. 1 is a side sectional view of the surroundings of a safety bar in a rotary press showing an embodiment of the present invention. FIG. 2 is a view taken in the direction of an arrow A shown in FIG. 1. FIG. 3 is a side sectional view of the surroundings of a cover. FIG. 4 is a view taken in the direction of an arrow B shown in FIG. 3. FIG. 5 is a schematic configuration drawing of the surroundings of a plate changing device.

As shown in FIG. 5, an ink form roller (first rotating part) 2*a* and a rider roller (second rotating part) 2*b* of ink rollers, a plate cylinder (first rotating part) 3, and a blanket cylinder (second rotating part) 4 in an upper printing section (upper printing unit) are rotatably supported between right and left frames 1 of a rotary press (perfecting printing press), and a web passing between the blanket cylinder 4 and a blanket cylinder (not shown) of a lower printing section (lower printing unit) is subjected to printing. The upper printing unit and the lower printing unit constitute a set, and a plurality of such sets are arranged in line in the direction of travel of the web, although these features are not shown. These cylinders are rotated in an interlocked manner by a drive device (to be described later) via a power transmission mechanism.

A plate changing device is provided for each of the upper printing unit and the lower printing unit of each of the sets mentioned above. The plate changing devices in the upper printing unit and the lower printing unit are of nearly the same basic construction, and are disposed vertically and symmetrically with respect to each other. Moreover, various constructions can be applied for them. Thus, only the plate changing device of the upper printing unit will be taken as an example, and explained briefly.

A loader 6 is supported between the right and left frames 1 to be rotatable about a pivot shaft 5 (see the locus of rotation, C, in the drawing). Within the loader 6, a new plate $W_1$ and a removal plate (plate to be removed) $W_2$ are to be gripped by a new plate hooking member 7 and a removal plate hooking member 8, respectively.

For a plate supply, the loader 6 is rotated clockwise to the illustrated state by an actuator (not shown). Then, the new plate hooking member 7, with which the trailing edge of the new plate $W_1$ is engaged, is moved obliquely and downwardly from an ascent limit by a new plate moving actuator 28, such as a rodless cylinder, whereby the new plate $W_1$ is supplied to the plate cylinder 3.

For a plate removal, with the loader 6 located at the same position as mentioned above, the removal plate hooking member 8, with which the trailing edge of the removal plate $W_2$ is engaged, is moved obliquely and upwardly from a descent limit by a removal plate accommodating actuator 29, such as a rodless cylinder, whereby the removal plate $W_2$ is accommodated into the loader 6.

Between the right and left frames 1, a cover (covering member) 13, which prevents scatter of ink as a solvent and functions as a guide for guiding the plate during the plate removal, is provided via a bracket 12 in such a manner as to approach the ink form roller 2*a* and the rider roller 2*b* of the ink rollers and to cover the rollers 2*a* and 2*b*. A moving plate guide 10 is supported to be swingable between an advance position and a receding position about a pivot shaft 15 by an actuator 14, such as an air cylinder. A plate dismounting guide 16 is supported by the moving plate guide 10 to be swingable between an advance position and a receding position about a pivot shaft 18 by a plate dismounting actuator 17, such as an air cylinder, via a lever 19.

Between the right and left frames 1 and below the moving plate guide 10, a plate press roller 20 is supported to be swingable between an advance position and a receding position by a lever (not shown) and a plate press roller actuator (not shown), such as an air cylinder. Also, between the right and left frames 1, a safety bar (covering member) 21 for prevention of engulfment extends in the vicinity of the plate cylinder 3 and the blanket cylinder 4, and in such a manner as to cover a spacing between the cylinders 3 and 4. In FIG. 5, reference numeral 25 denotes a winding bar rotatably fitted within a gap 26 of the plate cylinder 3.

In the present embodiment, the safety bar 21, as shown in FIG. 1, is provided in a range surrounded by a facing area where the plate cylinder 3 and the blanket cylinder 4 are opposed to each other, the circumferential surface of the plate cylinder 3 (first outer peripheral surface) upstream of the facing area in the direction of rotation of the plate cylinder 3, the circumferential surface of the blanket cylinder 4 (second outer peripheral surface) upstream of the facing area in the direction of rotation of the blanket cylinder 4, and a surface in contact with the circumferential surface of the plate cylinder 3 and the circumferential surface of the blanket cylinder 4 (see an imaginary plane L in FIG. 5). In the safety bar 21, a plurality of air vents (openings) 22 for allowing circulation and exchange of air in a region surrounded by the circumferential surfaces of the cylinders, the safety bar 21 (the region indicated by a hatching in FIG. 1), and the outside air are formed at predetermined intervals in a longitudinal direction, as shown in FIG. 2.

In the cover 13 as well, a plurality of air vents (openings) 23 for allowing circulation and exchange of air in a region surrounded by the circumferential surfaces of the ink form roller 2*a*, the rider roller 2*b*, the cover 13 (the region indicated by a hatching in FIG. 3), and the outside air are formed in two rows in the direction of web travel and at predetermined intervals in a direction perpendicular to the direction of web travel (namely, in a width direction of the web), as shown in FIGS. 3 and 4.

The ranges D in the direction perpendicular to the direction of web travel, where the air vents 22 and 23 are formed in the safety bar 21 and the cover 13, (in other words, the lengths over which the air vents 22 and 23 are formed) are shorter than the lengths of the cylinders 3, 4 and the rollers 2*a*, 2*b*, so that there are no air vents 22, 23 at locations corresponding to the end portions in the axial direction of the cylinders 3, 4 and the rollers 2*a*, 2*b*. The shapes, diameters, numbers and pitches of the air vents 22, 23 are not limited to the illustrated examples, but can be set arbitrarily; for example, one slit-shaped air vent may be formed.

According to the present embodiment, as described above, the air vents 22 and 23 are formed in the safety bar 21 and the cover 13. Thus, circulation and exchange of air in the regions covered by these members (i.e., the hatched regions in FIGS. 1 and 3) and the outside air are promoted in a machine operating state in which the cylinders 3, 4 and the rollers 2*a*, 2*b* are rotated. As a result, the temperature difference between the interior of the regions and the outside air is eliminated to prevent dew formation on the safety bar 21 and the cover 13 located in the vicinity of the above-mentioned regions. Consequently, water droplets are kept from falling and adhering to the web (printing product), thereby causing a printing failure.

Moreover, the necessary step is only to punch the existing safety bar 21 and the cover 13. Thus, the clearances between these members and the cylinders 3, 4 and the rollers 2*a*, 2*b* need not be changed, so that the original functions of the safety bar 21 and cover 13 are not impaired. Furthermore, punching alone suffices, thus lowering costs in comparison with the use of air blowing means or a fan. Besides, the space used is unchanged, and thus the present invention can be easily applied to the existing machine.

In addition, the ranges D where the air vents 22, 23 are formed (in other words, the lengths over which the air vents 22, 23 are formed) are shorter than the lengths of the cylinders 3, 4 and the rollers 2*a*, 2*b*, and the air vents 22, 23 are not formed at the locations corresponding to the end portions in the axial direction of the cylinders 3, 4 and the rollers 2*a*, 2*b*. Hence, in the case of the cover 13, in particular, ink building up in the opposite end portions of the rollers 2*a*, 2*b* is prevented from dripping downward trough the air vents 23. Unless the air vents 22, 23 are formed at the locations corresponding to the end portions in the axial direction of the cylinders 3, 4 and the rollers 2*a*, 2*b*, the air vents 22, 23 may be formed in end portions of the safety bar 21 and the cover 13 which are beyond the above-mentioned ranges D.

Furthermore, the safety bar 21 is provided in the range surrounded by the facing area where the plate cylinder 3 and the blanket cylinder 4 are opposed to each other, the circumferential surface of the plate cylinder 3 upstream of the facing area in the direction of rotation of the plate cylinder 3, the circumferential surface of the blanket cylinder 4 upstream of the facing area in the direction of rotation of the blanket cylinder 4, and the plane in contact with the circumferential surface of the plate cylinder 3 and the circumferential surface of the blanket cylinder 4. Thus, air in the aforementioned region surrounded by the circumferential surfaces of the cylinders and the safety bar 21 is effectively circulated and released through the air vents 22 by utilizing air engulfed into this region during rotation of the cylinders 3 and 4.

While the present invention has been described by the above embodiment, it is to be understood that the invention is not limited thereby, but may be varied or modified in many other ways. For example, the safety bar 21 or the cover 13 may be divided into a plurality of members, and gaps created between them may be used as the openings. Moreover, the covering member is not limited to the safety bar 21 or the cover 13, and the present invention can be applied to various bars or covers of a printing press. Particularly, a flow of the outside air is utilized, so that the present invention can be adopted for a place whose surface should not become dry, such as a printing cylinder using ink as a solvent, the roller of a dampener using water as a solvent, or the roller of a varnish coater using varnish as a solvent. Such variations or modifications are not to be regarded as a departure from the spirit and scope of the invention, and all such variations and modifications as would be obvious to one skilled in the art are intended to be included within the scope of the appended claims.

What is claimed is:

1. A covering device for rotating parts, comprising:

a first rotating part supported rotatably;

a second rotating part opposing said first rotating part and supported rotatably; and a covering member, located in a vicinity of said first rotating part and said second rotating part, for covering at least a spacing between said first rotating part and said second rotating part, said covering member being provided with an opening, wherein said covering member is a safety bar for preventing a wrap-in in a printing press, and wherein said opening is a hole provided in said safety bar, such that air engulfed from a clearance between the safety bar and a first circumferential surface of the first rotating part and from a clearance between the safety bar and a second circumferential surface of the second rotating part into a region defined by the first circumferential surface, the second circumferential surface, and the safety bar by rotation of the first rotating part and the second rotating part, is released outside the region through the hole, wherein said covering member is provided in a range surrounded by a facing area where said first rotating part and said second rotating part are opposed to each other, a first outer peripheral surface of said first rotating part upstream of said facing area in a direction of rotation of said first rotating part, a second outer peripheral surface of said second rotating part upstream of said facing area in a direction of rotation of said second rotating part, and a plane in contact with said first outer peripheral surface and said second outer peripheral surface.

2. The covering device for rotating parts according to claim 1, wherein said opening releases air accumulating in an area upstream of the facing area, where said first rotating part and said second rotating part are opposed to each other, in a direction of rotation.

3. The covering device for rotating parts according to claim 1, wherein said opening is provided inwardly of opposite end portions of each of said first and second rotating parts.

4. The covering device for rotating parts according to claim 3, wherein a plurality of said openings are formed at predetermined intervals in a longitudinal direction of said first and second rotating parts.

5. The covering device for rotating parts according to claim 1, wherein said opening is not provided at a position corresponding to each of opposite end portions of said first and second rotating parts.

6. The covering device for rotating parts according to claim 1, wherein opposite end portions of said first and second rotating parts are located outwardly of a range in which said opening is provided.

* * * * *